United States Patent [19]

Good

[11] Patent Number: 4,466,566

[45] Date of Patent: Aug. 21, 1984

[54] METHOD OF FORMING A THIN WALLED ANNULAR CHANNEL

[75] Inventor: William K. Good, Pontiac, Mich.

[73] Assignee: Koppy Corporation, Ferndale, Mich.

[21] Appl. No.: 296,410

[22] Filed: Aug. 26, 1981

[51] Int. Cl.[3] ..... B23K 31/02

[52] U.S. Cl. ..... 228/155; 72/352

[58] Field of Search ..... 228/155; 72/354, 358, 72/359, 352, 133, 166

[56] References Cited

U.S. PATENT DOCUMENTS 2,983,033 5/1961 Cox ..... 72/358 X 3,851,517 12/1974 Greenleaf ..... 72/352

*Primary Examiner*—Nicholas P. Godici

*Assistant Examiner*—P. Weston Musselman, Jr.

*Attorney, Agent, or Firm*—Cullen, Sloman, Cantor, Grauer, Scott & Rutherford

[57] ABSTRACT

A method of forming a thin walled annular channel or semi-toroidal shell from a flat rectalinear sheet, including forming the sheet into a cylindrical band and welding or otherwise securing the abutting free ends of the band. The cylindrical band is then forced into a die set having a cylindrical opening which smoothly blends into an inwardly curving semi-toroidal space defined by opposed concave and convex die surfaces. The cylindrical band is curled inwardly and compressed by the die surfaces, accurately conforming the band and the weldment to the outer concave die surface and eliminating tensile fracture of the weldment.

5 Claims, 8 Drawing Figures

METHOD OF FORMING A THIN WALLED ANNULAR CHANNEL

FIELD OF THE INVENTION

The method or forming process of this invention relates generally to sheet metal forming processes, wherein the work piece is forced between opposed convex and concave spaced die surfaces. More particularly, the method of this invention is adapted to form a thin walled semi-toroidal shell from flat sheet stock, wherein the sheet is first formed into a cylindrical band, welded and the band is then curled inwardly and compressed by the die surfaces, thus eliminating tensile fracture of the weld and accurately conforming the workpiece to the die surfaces.

DESCRIPTION OF THE PRIOR ART

The method of this invention is adapted to form thin walled annular channels, generally U-shaped in cross-section or laterally bisected toroidal shells. Such shells are presently used in hydromatic couplings or converters, wherein radially extending blades or fins are secured in slots in the exterior surface of the shells to form a rotor. Two rotors are used in an automotive torque converter in open face-to-face relation, forming a finned toroid. The exterior surface configuration of the semi-toroidal shells are thus critical to proper functioning of the torque converter. For example, the exterior tolerances of the semi-toroidal shell used in an automotive torque converter must be maintained to plus or minus 5% of the material thickness. Thus, in a toroidal shell having a thickness of 0.040 inches, the tolerance must be maintained to plus or minus 0.002 inches.

Toroidal shells are presently formed commercially by cutting or stamping a washer-shaped blank from flat metal sheet stock, resulting in a substantial waste of material, which increases the cost of the shell. The blank is then formed into a semi-toroidal shell in a conventional die stamping process.

The method of this invention substantially eliminates scrap, thus reducing the cost of the shells. U.S. Pat. No. 3,851,517, assigned to General Motors Corporation, discloses a process of forming semi-toroidal shells from flat strip stock, which would have eliminated scrap, but was unsuccessful commercially. The process disclosed in this patent, which is incorporated herein by reference, utilizes a rectangular sheet metal blank, which is rolled into a cylinder and welded. The end of the cylinder is then forced into a first pre-form due set to initially turn outwardly or flare the top edge of the cylinder. The flared end of the cylinder is then forced into a second curling die set having spaced concave and matching convex outwardly curved die surfaces, curling the cylinder outwardly under tension and forming a semi-toroidal shell. Finally, the shell is formed to its final configuration in a third re-strike die set.

The weldment had to be accurately controlled, planished and smoothed prior to forming because the weld is placed under extreme tensile stress during the curl forming operation. Nevertheless, the process disclosed in the above-referenced patent was unsuccessful commercially because the weld failed or fractured repeatedly under the tensile stress created by curling the cylinder outwardly and the method was finally abandoned. Further, the workpiece tended to pull away from the concave die surface under the tensile forces generated by the curling operation, making it difficult to control the critical exterior tolerances of the shell.

The method of this invention eliminates the problems inherent in the above-referenced patent by curling the cylindrical band inwardly, thereby placing the weldment in compression. In fact, the semi-toroidal shell may be formed by the method of this invention without welding or by joining the abutting ends of the band by other means, making the process suitable for other applications. Further, the shell may be formed in one stroke of the press, thereby eliminating the requirement for pre-forming a flared end on the cylinder as required in the above-referenced patent.

SUMMARY OF THE INVENTION

The method of forming a thin walled semi-toroidal shell of this invention includes forming a flat rectilinear sheet into a cylindrical band and preferably joining the abutting free ends of the band, particularly for the above-described applications of the semi-toroidal shell. One end of the cylindrical band is then forced into a die set having a cylindrical opening smoothly blending into an inwardly curving semi-toroidal space defined by opposed concave and convex spaced die surfaces. The diameter of the cylindrical band is equal to the nominal diameter of the die set opening which is located at the radial outer extent of the die surfaces. As the cylindrical band is forced into the toroidal space between the concave and convex die surfaces, the band is progressively curled inwardly under compression to confom to the semi-toroidal space. The cylinder is thus placed under compressive force and the outer toroidal surface of the workpiece accurately conforms to the concave die surface.

In the preferred method of forming a toroidal shell suitable for hydromatic couplings or converters, such as automotive torque converters, the free ends of the band are preferably welded. The weld is thus wiped and compressed against the annular concave die surface as the band is progressively curled inwardly, accurately conforming the exterior welded surface to the concave die surface.

The weldment is thus not subject to tensile fracture as in the prior art method discussed hereinabove. As understood, a weld is not as pure as the parent metal and a weld is subject to fracture in commercial applications when the weld is expanded approximately twenty percent. There is no known limit to compressive forces. Further, the semi-toroidal shell may be formed by the method of this invention in one stroke of the press, eliminating the requirement for pre-forming a flared end on the cylinder, although the semi-toroidal shell may be restruck in a restrike die to form a more complex configuration. Finally, the critical exterior surface of the toroidal shell is easily held within close tolerances because the exterior surface accurately conforms to the concave die surface under the compressive curling forces.

Other advantages and meritorious features of the method of this invention will be more fully understood from the following detailed description of the method of this invention, the appended claims and the drawings, a brief description of which follows.

DESCRIPTION OF THE PREFERRED METHOD OF THIS INVENTION

Figure 2:
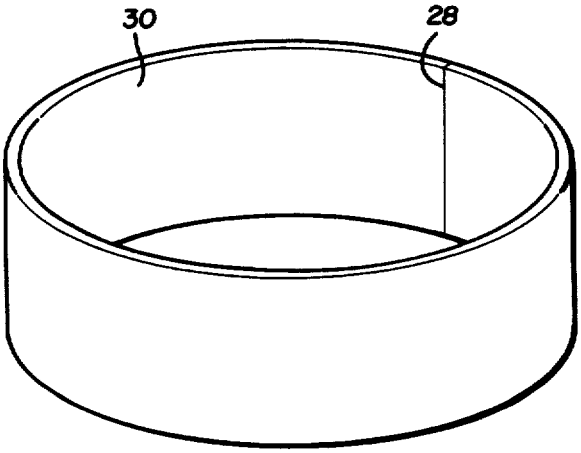
FIG. 2 is a side elevation of a cylindrical band which forms the semi-toroidal shell of FIG. 1.
Figure 1:
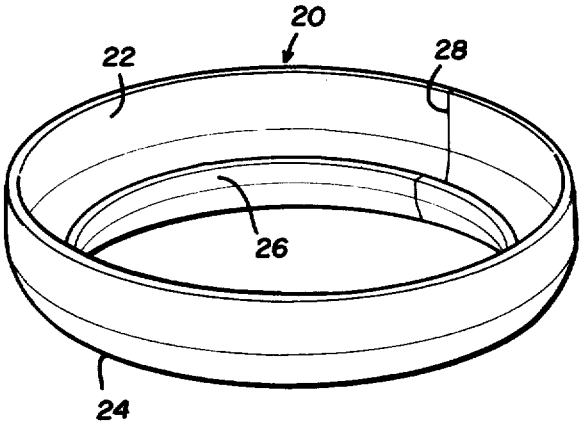
FIG. 1 is a side elevation of a semi-toroidal shell formed by the method of this invention.

FIG. 1 illustrates a thin walled annular channel or semi-toroidal shell 20 which may be formed by the method of this invention. The shell includes an outer cylindrical lip 22, a U-shaped mid portion 24, and an inner lip 26. The shell is formed from a cylindrical band 30, as shown in FIG. 2. The cylindrical band may be formed from a flat rectalinear strip which is rolled and welded as at 28, which forms a weld in the semi-toroidal shell, as shown in FIG. 1. The method of forming a cylindrical band as shown in FIG. 2 is described in more detail in the above-referenced patent assigned to General Motors Corporation.

Figure 3:
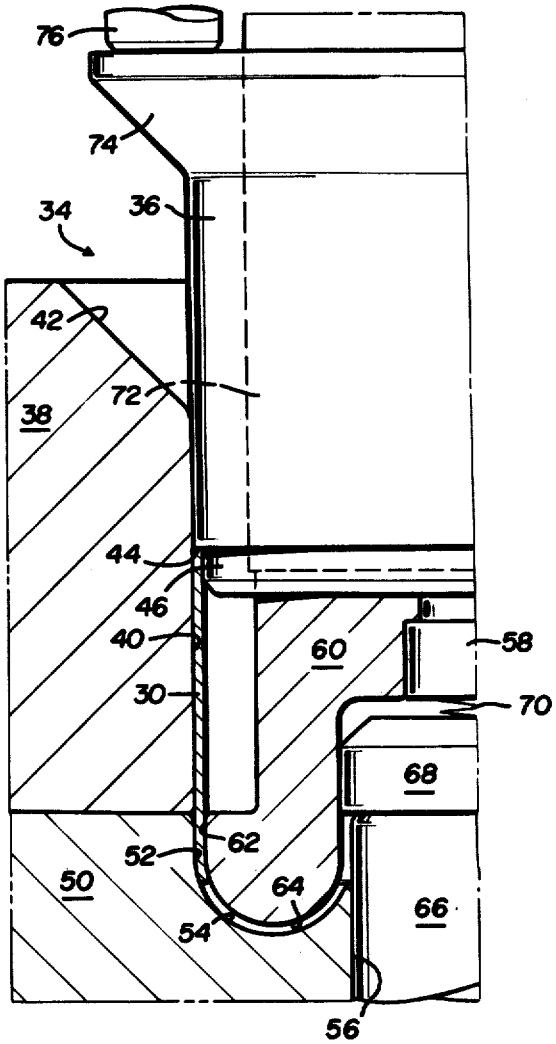
FIG. 3 is a side, partially cross-sectioned view of one embodiment of a die set used in the method of this invention with the ram starting to form the cylindrical band of FIG. 2.
Figure 4:
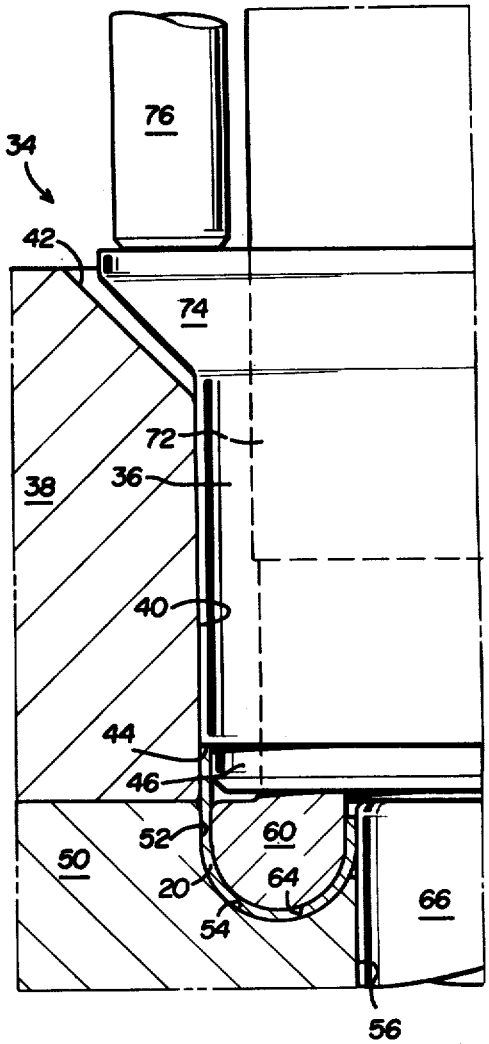
FIG. 4 is a side cross-sectional view of the die set shown in FIG. 3 with the ram lowered, forming the semi-toroidal shell shown in FIG. 4.

The semi-toroidal shell of FIG. 1 may be formed by the die set assembly 34 shown in FIGS. 3 and 4. The die set assembly includes an annular cylindrical ram 36 which is received in the cylindrical bore 40 of riser 38. The riser includes a conical counter-bore 42 which receives the cylindrical band 30, when the ram 36 is raised above the position shown in FIG. 3. The ram includes an annular lip 44 which engages the cylindrical band 30 and an end portion 46.

The cylindrical band is received in a curl die 50 having an annular cylindrical surface 52 which first receives the cylindrical band and an annular concave surface 54 terminating in a cylindrical bore 56. An annular forming post 60 is received within the curl die 50 having a cylindrical exterior surface 62 opposite the cylindrical surface 52 of the curl die and an annular convex surface 64 opposite the concave surface 54 of the curl die. The forming post and curl die thus form a U-shaped annular space which receives the cylindrical band 30, as described hereinbelow.

The die set assembly also includes a static cylindrical center post 66, a spring pad 68 and a plurality of helical coil springs 70 which are biased against a cylindrical insert 58 in the forming post 60. A center guide post 72 having a cylindrical exterior surface receives the ram in telescopic relation and the ram includes a conical flange 74, which receives die pins 76. The die pins are bolted or otherwise secured to the upper die platten, not shown. In the disclosed embodiment, there are four die pins 76 and four springs 70. It will be understood by those skilled in the art that only half of the die assembly is shown to illustrate the method of this invention and the die assembly normally includes a lower die platten which supports the curl die 50 on a conventional bolster assembly, not shown. Reference may also be made to the above-referenced U.S. patent.

The method of this invention thus includes forming the cylindrical band 30 of FIG. 2 from flat strip stock and welding the free ends of the strip, as shown at 28. As described above, the free ends of the band may also be joined by other means, including Tig welding, which includes fusing points of the band or other means. In fact, the band may be formed into a U-shaped annular channel without joining the abutting free ends of the band because the method of this invention compresses the band during forming.

One end of the cylindrical band 30 is then forced into the semi-toroidal space defined by the curl die 50 and forming post 60. In the preferred embodiment, the opening to the space is cylindrical, as defined by the opposed cylindrical surfaces 52 and 62. As shown, the cylindrical opening smoothly blends into the semi-toroidal space defined by the annular concave and convex surfaces, 54 and 64 respectively, of the curl die 50 and forming post 60, respectively. The nominal diameter of the cylindrical band 30 is equal to the nominal diameter of the cylindrical opening between the curl die 50 and the forming post 60. The opposed end of the cylindrical band is engaged by the annular lip 44 of the ram. Lowering of the ram 36 thus forces the cylindrical band downwardly in FIG. 3, progressively curling the band radially inwardly between the curl die and forming post, compressing the cylindrical band and the weld 28, as shown in FIG. 4. The semi-toroidal shell 20 is thus formed in one stroke of the press, eliminating the requirement of a pre-forming step, as described in the above-referenced patent.

As described above, the method of this invention results in a fifty percent savings in material costs over the present method which includes die forming the semi-toroidal shell from a washer-shaped blank. The exterior surface of the semi-toroidal shell accurately conforms to the concave surface 54 of the curl die because the band is curled inwardly, compressing the band and conforming the band to the curl die. More importantly, the weld 28 is placed in compression, eliminating tensile fracture of the weld as experienced in the method described in the above-referenced patent. Further, the exterior surface of the weld 28 is wiped against the concave surface 54, accurately conforming the weld to the concave surface. Because the band is placed in compression during forming, rather than tension, the band does not tend to pull away from the exterior die surfaces, maintaining the critical exterior surface within tolerance.

Figure 6:
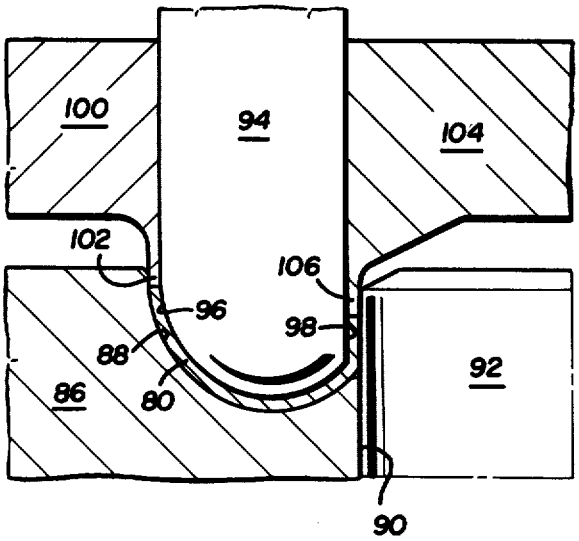
FIG. 6 is a partial side cross-sectional view of one embodiment of a restrike die utilized to form the semi-toroidal shell of FIG. 5.
Figure 5:
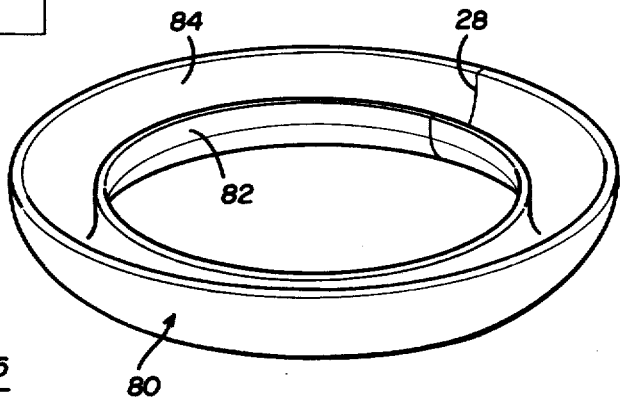
FIG. 5 is a semi-toroidal shell of FIG. 1 after restriking.

The semi-toroidal shell 20 may be formed in a further operation depending upon the application. For example, a core ring impeller for an automotive hydromatic coupling or converter normally includes a cylindrical inner surface which receives a shaft, as shown at 80 in FIG. 5. This configuration may be formed in a restrike die set, as shown in FIG. 6. The semi-toroidal shell 80 shown in FIG. 5 includes a cylindrical inner lip portion 82 and an outer semi-toroidal portion 84.

The restrike die assembly includes a female die member 86 which corresponds to the curl die 50 of FIGS. 3 and 4, having an annular concave surface 88 which receives the static cylindrical center post 92. The forming post 94 includes an annular convex surface 96 and a cylindrical surface 98. As described above in regard to FIGS. 3 and 4, the female die 86 and forming post 94 are spaced to define a semi-toroidal space therebetween and the shell 80 is formed by the die members.

Figure 7:
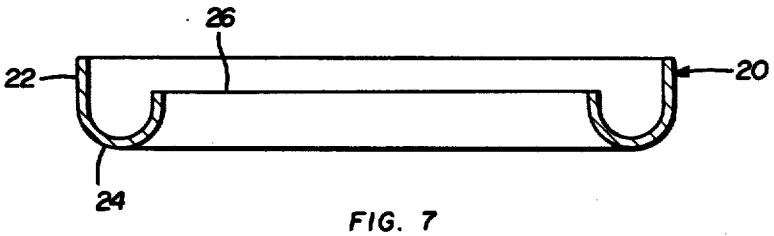
FIG. 7 is a side cross-sectional view of the semi-toroidal shell shown in FIG. 1.
Figure 8:
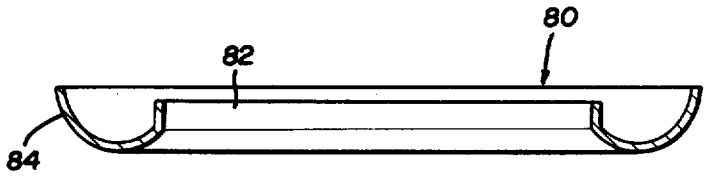
FIG. 8 is a side cross-sectional view of the semi-toroidal shell shown in FIG. 5.

In the disclosed embodiment of the restrike die assembly shown in FIG. 6, the shell is retained by an outer retainer ring 100 having an annular lip 102 and an inner retainer ring 104 having an annular lip 106. The semi-toroidal shell 20 shown in FIG. 1 is inserted into the female die member 86 and forming post 94 and retainer rings 100 and 104 are lowered into the female die to form the final configuration of the semi-toroidal shell 80 shown in FIG. 5. The change in the shell configuration is best understood by comparing FIGS. 7 and 8, wherein FIG. 7 illustrates the cross-sectional configuration of the semi-toroidal shell 20 of FIG. 1 and FIG. 8 illustrates the cross-sectional shape of the semi-toroidal shell 80 of FIG. 5. The restrike die assembly expands the shell, reforming the cylindrical outer lip 22 into a continuous outer semi-toroidal portion 84, as shown in FIG. 8, and the inner lip 26 is reformed into a cylindrical lip 82, as shown in FIG. 8.

The method of this invention thus substantially reduces the cost of forming a semi-toroidal shell by forming the shell from a rectangular strip of sheet material, which is rolled and welded as shown in FIG. 2. This results in a substantial saving in material. Further, the shell is formed in one stroke of the press, as shown in FIGS. 3 and 4, without imparting tensile stress to the weld 28. The shell may be formed from various materials, depending upon the application. For example, a core ring impeller may be formed from 1010 or 1018 sheet steel having a thickness of, for example, 0.040 inches. As described above, the weld 28 is placed in compression during the curl forming process shown in FIGS. 3 and 4. The external lip 22 of the shell is expanded in the restrike die set assembly of FIG. 6, however, the expansion is less than ten percent to avoid fracture of the weld. The method of this invention thus avoids tensile forces on the weld which would fracture the weld in production while forming the complex semi-toroidal shell configuration shown in FIG. 5.

I claim:

1. A method of forming a thin walled semi-toroidal shell, generally U-shaped in cross-section, comprising the steps of:

(a) forming a flat rectilinear sheet having free end portions and top and bottom edges into a cylindrical band with said free end portions abutting and said top and bottom edges forming the top and bottom ends of said cylindrical band;

(b) joining said abutting end portions;

(c) forcing one end of said cylindrical band into a semi-toroidal space defined between die members having opposed concave and convex generally evenly spaced matching fixed die surfaces and an opening at the radial outer extent of said semi-toroidal space, the nominal diameter of said cylindrical band equal to the radial outer opening of said toroidal space, including engaging the opposed end of said cylindrical band, forcing said band between said fixed die surfaces, said die surfaces thereby progressively curling said band radially inwardly between said concave and convex die surfaces in said semi-toroidal space, compressing said cylindrical band and the junction between said abutting ends, thereby forming said cylindrical band into a semi-toroidal shape.

2. The method of forming a semi-toroidal shell defined in claim 1, wherein said abutting end portions are joined by welding and said weld is wiped and compressed against said annular concave die surface, conforming said welded surface to said concave die surface.

3. A methlod of forming a thin walled semi-toroidal shell, generally U-shaped in cross section, comprising the following steps:

(a) forming a flat rectilinear sheet having free end portions and top and bottom edges into a cylindrical band with said free end portions abutting;

(b) welding said abutting ends of said cylindrical band;

(c) providing a die set having opposed concave and convex generally evenly spaced fixed die surfaces forming a semi-toroidal space having a cylindrical opening at the radial outer extent of said opening, said toroidal space smoothly blending from a generally cylindrical space adjacent said opening into said semi-toroidal space;

(d) forcing one end of said cylindrical band into said cylindrical opening, by engaging the opposed end of said band, then progressively curling said band inwardly under compression into said semi-toroidal space between said concave and convex fixed die surfaces, wiping and compressing said weld against said concave die surface and forming said cylindrical band into a semi-toroidal shape having an outer toroidal surface accurately conforming to said concave die surface.

4. A method of forming a thin walled channel-shaped shell, generally U-shaped in cross-section, comprising the steps of:

(a) bending a flat, rectangular sheet having free end portions into a cylindrical band with said free end portions abutting;

(b) joining said abutting ends of said cylindrical band;

(c) inserting one cylindrical end of said band into a die set having a cylindrical opening at the radial outer extent and opposed generally evenly spaced concave and convex matching fixed die surfaces forming an opening generally U-shaped space smoothly blending with said cylindrical opening, said cylindrical band having a nominal diameter equal to said cylindrical opening; and (d) forcing said cylindrical band into said U-shaped space between said concave and convex die surfaces by engaging the opposed end of said band, curling said cylindrical band inwardly and accurately conforming the outer surface of said band to the outer concave die surface and compressing the joint between said abutting band ends and forming a channel-shaped shell generally U-shaped in cross-section.

5. The method of forming a thin walled channel-shaped shell defined in claim 4, including welding said abutting ends of said cylindrical band and wiping and compressing the weld against said annular concave die surface, accurately conforming said weldment to the surface of said concave die surface.

* * * * *